US007722999B2

(12) United States Patent
Levy et al.

(10) Patent No.: US 7,722,999 B2
(45) Date of Patent: May 25, 2010

(54) SILICONE FREE POLYESTER IN UNDERCOAT LAYER OF PHOTOCONDUCTIVE MEMBER

(75) Inventors: Daniel V. Levy, Rochester, NY (US); Jin Wu, Webster, NY (US); Liang-Bih Lin, Rochester, NY (US); Francisco J. Lopez, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 635 days.

(21) Appl. No.: 11/496,791

(22) Filed: Aug. 1, 2006

(65) Prior Publication Data

US 2008/0032220 A1 Feb. 7, 2008

(51) Int. Cl.
*G03G 5/14* (2006.01)

(52) U.S. Cl. ..... 430/58.8; 430/58.75; 430/60; 430/65; 430/59.4; 430/59.5

(58) Field of Classification Search ..... 430/58.8, 430/58.75, 60, 65, 59.4, 59.5
See application file for complete search history.

(56) References Cited

U.S. PATENT DOCUMENTS

| | | | | |
|---|---|---|---|---|
| 4,173,472 | A * | 11/1979 | Berwick et al. | 430/60 |
| 4,265,990 | A | 5/1981 | Stolka et al. | |
| 4,381,337 | A * | 4/1983 | Chang | 430/59.1 |
| 4,464,450 | A | 8/1984 | Teuscher | |
| 4,786,570 | A * | 11/1988 | Yu et al. | 430/58.8 |
| 4,921,769 | A | 5/1990 | Yuh et al. | |
| 5,385,796 | A | 1/1995 | Spiewak et al. | |
| 5,449,573 | A | 9/1995 | Aoki et al. | |
| 5,473,064 | A | 12/1995 | Mayo et al. | |
| 5,595,847 | A * | 1/1997 | Nogami et al. | 430/64 |
| 5,928,824 | A | 7/1999 | Obinata et al. | |
| 6,015,645 | A | 1/2000 | Murti et al. | |
| 6,156,468 | A | 12/2000 | Wehelie et al. | |
| 6,177,219 | B1 | 1/2001 | Yuh et al. | |
| 6,180,309 | B1 | 1/2001 | Maty et al. | |
| 6,200,716 | B1 | 3/2001 | Fuller et al. | |
| 6,207,334 | B1 | 3/2001 | Dinh et al. | |
| 6,255,027 | B1 | 7/2001 | Wehelie et al. | |
| 6,287,737 | B1 | 9/2001 | Ong et al. | |
| 6,893,680 | B2 * | 5/2005 | Newton | 427/292 |
| 6,913,863 | B2 | 7/2005 | Wu et al. | |
| 2003/0232265 | A1 * | 12/2003 | Yamanami et al. | 430/65 |
| 2006/0057480 | A1 | 3/2006 | Wu et al. | |
| 2006/0100302 | A1 * | 5/2006 | Krohn | 522/81 |

OTHER PUBLICATIONS

Diamond, Arthur S & David Weiss (eds.) Handbook of Imaging Materials, 2nd ed.. New York: Marcel-Dekker, Inc. (Nov. 2001) pp. 401-403.*
Startomer Product Catalog (Mar. 2004).*
Jin Wu et al., U.S. Appl. No. 11/211,757 on Novel Thick Undercoats, filed Aug. 26, 2005.
Liang-Bih Lin et al., U.S. Appl. No. 11/403,981 on Improved Imaging Member, filed Apr. 13, 2006.
Jin Wu et al., U.S. Appl. No. 11/410,593 on Imaging Member Having Styrene, filed Apr. 25, 2006.
Jin Wu et al., U.S. Appl. No. 11/453,618 on Ether Containing Photoconductors, filed Jun. 15, 2006.

* cited by examiner

*Primary Examiner*—Christopher RoDee
(74) *Attorney, Agent, or Firm*—E. O. Palazzo

(57) ABSTRACT

A photoconductor containing a substrate, a layer thereover, which layer contains, for example, a polyol resin, an aminoplast resin, a silicone free polyester, and a metal oxide dispersed therein; and at least one imaging layer formed on the polyol resin containing layer.

26 Claims, No Drawings

SILICONE FREE POLYESTER IN UNDERCOAT LAYER OF PHOTOCONDUCTIVE MEMBER

CROSS REFERENCE TO RELATED APPLICATIONS

U.S. application Ser. No. 11/496,790, U.S. Publication No. 20080032219, filed Aug. 1, 2006, the disclosure of which is totally incorporated herein by reference, on Polyester Containing Member.

U.S. application Ser. No. 11/496,923, now U.S. Pat. No. 7,534,536, the disclosure of which is totally incorporated herein by reference, on Polyarylate Containing Member.

U.S. application Ser. No. 11/496,915, U.S. Publication No. 20080032218, filed Aug. 1, 2006, the disclosure of which is totally incorporated herein by reference, on Silanol Containing Photoconductor.

U.S. application Ser. No. 11/496,800, U.S. Publication No. 20080032216, filed Aug. 1, 2006, the disclosure of which is totally incorporated herein by reference, on Phosphate Ester Containing Photoconductors.

U.S. application Ser. No. 11/496,912, U.S. Publication No. 20080032217, filed Aug. 1, 2006, the disclosure of which is totally incorporated herein by reference, on Phosphoric Acid Ester Containing Photoconductors.

Disclosed in copending application U.S. application Ser. No. 10/942,277, U.S. Publication No. 20060057480, now U.S. Pat. No. 7,312,007, the disclosure of which is totally incorporated herein by reference, is a photoconductive member comprised of a supporting substrate, a hole blocking layer thereover, a photogenerating layer, and a charge transport layer, and wherein the hole blocking layer is comprised of a metallic component and a binder component, such as a phenolic resin.

Disclosed in application U.S. application Ser. No. 11/211,757, now U.S. Pat. No. 7,544,452, the disclosure of which is totally incorporated herein by reference, is an electrophotographic imaging member comprising a support layer, an undercoat layer of a binder of metal oxide nanoparticles, and a co-resin comprising a phenolic resin and an aminoplast resin; a charge generation layer, and a charge transport layer.

Disclosed in copending application U.S. application Ser. No. 11/403,981, U.S. Publication No. 20070243476, the disclosure of which is totally incorporated herein by reference, is an electrophotographic imaging member, comprising a substrate, an undercoat layer disposed on the substrate, wherein the undercoat layer comprises a polyol resin, an aminoplast resin, and a metal oxide dispersed therein; and at least one imaging layer formed on the undercoat layer, and wherein the polyol resin is, for example, selected from the group consisting of acrylic polyols, polyglycols, polyglycerols, and mixtures thereof.

Disclosed in copending application U.S. application Ser. No. 11/410,593, U.S. Publication No. 20070248813, the disclosure of which is totally incorporated herein by reference, is an electrophotographic imaging member, comprising a substrate; an undercoat layer disposed on the substrate, wherein the undercoat layer comprises a styrene acrylic copolymer, an aminoplast resin, and a metal oxide dispersed therein; and at least one imaging layer formed on the undercoat layer.

In U.S. application Ser. No. 11/453,618, filed Jun. 15, 2006, now U.S. Pat. No. 7,473,505, title Ether Containing Photoconductors, the disclosure of which is totally incorporated herein by reference, there is illustrated a photoconductor comprising an optional supporting substrate, a photogenerating layer, and at least one charge transport layer comprised of at least one charge transport component, at least one C-ether of the formula

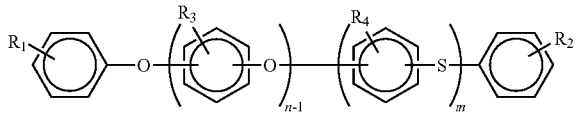

wherein $R_1$, $R_2$, $R_3$ and $R_4$ are independently selected from the group consisting of hydrogen, alkyl, aryl, alkoxy, substituted alkyl, substituted aryl, substituted alkoxy, and halogen, and the sum of n plus m (n+m) is from about 1 to about 10.

The appropriate components and processes, number and sequence of the layers, component and component amounts in each layer, and the thicknesses of each layer of the above copending applications, especially applications U.S. application Ser. No. 11/211,757, now U.S. Pat. No. 7,544,452; U.S. application Ser. No. 11/403,981, U.S. Publication No. 20070243476; and U.S. application Ser. No. 11/410,593, U.S. Publication No. 20070248813, may be selected for the present disclosure in embodiments thereof.

BACKGROUND

There is disclosed herein photoconductive adhesive layers, and more specifically, photoconductors containing a hole blocking layer or undercoat layer (UCL) comprised, for example, of metal oxide particles and adhesion components that permit the excellent adhesion between, for example, the hole blocking layer and the layer or layers thereunder, and the layers thereover, such as the photogenerating layer and the charge transport layer or layers. More specifically, there are disclosed hole blocking layers comprised of a number of the components as illustrated in the copending applications referred to herein, such as a metal oxide like a titanium dioxide, a polyol, a resin, such as a melamine resin, and an adhesion promoter, examples of which are a polymeric phosphate ester, such as a hydroxyl/carboxy functional polymeric phosphate ester available as LUBRIZOL™ 2063, a silicone free polyester, BORCHI GEN HMP™ available from Borchers GmbH; esters of phosphoric acid, polyacrylates based on monomers of methyl methacrylate, ethyl acrylate, acrylonitrile, or the like, such as poly-4,4'-isopropylidenediphenylene terephthalate/isophthalate copolymer available from Toyota Hsutsu; polyesters, such as MOR-ESTER™ 49,000 available from Morton International, vinyl ester resins, isophthalic polyester resin, and orthophthalic polyester resin; copolyesters, such as polyethyleneterephthalate glycol, and optionally mixtures thereof, and the like. Charge blocking layer and blocking layer are generally used interchangeably with the phrase "undercoat layer" (UCL), and monomer includes a single monomer or a plurality of monomers.

Also included within the scope of the present disclosure are methods of imaging and printing with the photoresponsive or the photoconductive devices illustrated herein. These methods generally involve the formation of an electrostatic latent image on the imaging member, followed by developing the image with a toner composition comprised, for example, of a thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members, photoconductor drums, and flexible belts disclosed herein can be selected for the Xerox Corporation iGEN3® machines that generate with some versions over 100 copies per minute. Processes of imaging, especially xerographic imaging and printing, including digital, and/or high speed color printing, are thus encompassed by the present disclosure.

The imaging members disclosed herein are in embodiments sensitive in the wavelength region of, for example, from about 400 to about 900 nanometers, and in particular from about 650 to about 850 nanometers, thus diode lasers can be selected as the light source.

REFERENCES

Illustrated in U.S. Pat. No. 6,913,863, the disclosure of which is totally incorporated herein by reference, is a photoconductive imaging member comprised of an optional supporting substrate, a hole blocking layer thereover, a photogenerating layer, and a charge transport layer, and wherein the hole blocking layer is comprised of a metal oxide, a mixture of phenolic resins, and wherein at least one of the resins contains two hydroxy groups.

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerating layer, and a charge transport layer, and wherein the blocking layer is comprised of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer, and a charge transport layer, and wherein the hole blocking layer is comprised of a crosslinked polymer generated, for example, from the reaction of a silyl-functionalized hydroxyalkyl polymer of Formula (I) with an organosilane of Formula (II) and water

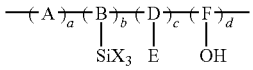

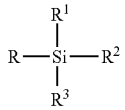

wherein, for example, A, B, D, and F represent the segments of the polymer backbone; E is an electron transporting moiety; X is selected, for example, from the group consisting of chloride, bromide, iodide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl with the substituent being halide, alkoxy, aryloxy, and amino; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in U.S. Pat. Nos. 6,255,027; 6,177,219, and 6,156,468, each of the disclosures thereof being totally incorporated herein by reference, are, for example, photoreceptors containing a charge blocking layer of a plurality of light scattering particles dispersed in a binder, reference for example, Example I of U.S. Pat. No. 6,156,468, wherein there is illustrated a charge blocking layer of titanium dioxide dispersed in a specific linear phenolic binder of VARCUM™, available from OxyChem Company.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by the reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$ for each part of gallium chloride that is reacted; hydrolyzing the pigment precursor chlorogallium phthalocyanine Type I by standard methods, for example, by acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 4,587,189, the disclosure of which is totally incorporated herein by reference, are photoconductive imaging members comprised of a supporting substrate, a charge transport layer, a photogenerating layer of BZP perylene, which is in embodiments comprised of a mixture of bisbenzimidazo(2,1-a-1',2'-b)anthra(2,1,9-def:6,5,10-d'e'f')diisoquinoline-6,11-dione and bisbenzimidazo (2,1-a:2',1'-a)anthra(2,1,9-def:6,5,10-d'e'f')diisoquinoline-10,21-dione.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

In U.S. Pat. No. 4,921,769, the disclosure of which is totally incorporated herein by reference, there are illustrated photoconductive imaging members with blocking layers of certain polyurethanes.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

An electrophotographic imaging member or photoconductor may be provided in a number of forms. For example, the imaging member may be a homogeneous layer of a single material such as vitreous selenium, or it may be a composite layer containing a photoconductor and another material. In addition, the imaging member may be layered. These layers can be in any order, and sometimes can be combined in a single or mixed layer. A number of photoconductors are disclosed in U.S. Pat. No. 5,489,496; U.S. Pat. No. 4,579,801; U.S. Pat. No. 4,518,669; U.S. Pat. No. 4,775,605; U.S. Pat. No. 5,656,407; U.S. Pat. No. 5,641,599; U.S. Pat. No. 5,344,734; U.S. Pat. No. 5,721,080; and U.S. Pat. No. 5,017,449, the entire disclosures of which are totally incorporated herein by reference. Also, photoreceptors are disclosed in U.S. Pat. No. 6,200,716; U.S. Pat. No. 6,180,309; and U.S. Pat. No. 6,207,334, the entire disclosures of which are totally incorporated herein by reference.

A number of undercoat or charge blocking layers are disclosed in U.S. Pat. No. 4,464,450; U.S. Pat. No. 5,449,573; U.S. Pat. No. 5,385,796; and, U.S. Pat. No. 5,928,824, the entire disclosures of which are totally incorporated herein by reference.

The demand for improved print quality in xerographic reproduction processes is increasing, especially with the advent of color. Common print quality issues are, for example, dependent on the quality of the undercoat layer (UCL), or hole blocking layer. In certain situations, a thicker undercoat is desirable, but the thickness of the material used for the undercoat layer may be limited by the inefficient transport of the photo-injected electrons from the generator layer to the substrate. When the undercoat layer is too thin, then incomplete coverage of the substrate may result due primarily to wetting problems on localized unclean substrate surface areas. The incomplete coverage produces pin holes which can, in turn, produce print defects such as charge deficient spots (CDS) and bias charge roll (BCR) leakage breakdown. Other problems include "ghosting", which is thought to result from the accumulation of charge somewhere in the photoreceptor. Removing trapped electrons and holes residing in the imaging members is one key to preventing or minimizing ghosting. During the exposure and development stages of xerographic cycles, the trapped electrons are mainly at or near the interface between the charge generating layer (CGL) and the undercoating layer (UCL), and holes are present mainly at or near the interface between the charge generating layer and the charge transport layer (CTL). The trapped charges can migrate according to the electric field during the transfer stage where the electrons can move from the interface of CGL/UCL to CTL/CGL or the holes from CTL/CGL to CGL/UCL, and became deep traps that are no longer mobile. Consequently, when a sequential image is printed, the accumulated charge results in image density changes in the current printed image that reveals the previously printed image. Thus, there is a need to minimize or eliminate charge accumulation in photoreceptors without sacrificing the thickness of the undercoat layer, and a need for permitting the UCL to properly adhere to the other photoconductive layers, such as the photogenerating layer, for extended time periods, such as for example, about 4,000,000 simulated xerographic imaging cycles.

Thick undercoat layers are desirable for photoreceptors as such layers permit photoconductor life extension and carbon fiber resistance. Furthermore, thicker undercoat layers permit the use of economical substrates in the photoreceptors. Examples of thick undercoat layers are disclosed in U.S. application Ser. No. 10/942,277, filed Sep. 16, 2004, U.S. Publication 20060057480, now U.S. Pat. No. 7,312,007, entitled "Photoconductive Imaging Members", the entire disclosure of which is totally incorporated herein by reference. However, due primarily to insufficient electron conductivity in dry and cold environments, the residual potential in conditions, such as 10 percent relative humidity and 70° F., can be unacceptably high when the undercoat layer is thicker than 15 microns, and moreover, the adhesion of the UCL may be poor, disadvantages avoided or minimized with the UCL of the present disclosure.

SUMMARY

According to embodiments illustrated herein, there are provided photoconductors that enable excellent print quality, and wherein ghosting is minimized or substantially eliminated in images printed in systems with high transfer current, and where adhesion of the UCL is improved as compared to a number of UCLs with no adhesion promoter.

In particular, disclosed in an embodiment is an electrophotographic imaging member comprising a substrate, an undercoat layer contained on the substrate, wherein the undercoat layer comprises a polyol resin, an aminoplast resin, and a metal oxide dispersed therein, and at least one imaging layer formed on the undercoat layer, and wherein the undercoat layer contains at least one adhesion agent, component, or promoter.

Embodiments disclosed herein also include an electrophotographic imaging member comprising a substrate, an undercoat layer disposed or deposited on the substrate, wherein the undercoat layer comprises an acrylic polyol or a styrene acrylic polyol resin, a melamine resin, an adhesion component, and titanium oxide dispersed therein, and a photogenerating layer and charge transport layer formed on the undercoat layer; an electrophotographic imaging member comprising a substrate, an undercoat layer disposed on the substrate, wherein the undercoat layer comprises a phenolic resin, a melamine resin, an adhesion component, and titanium oxide dispersed therein, and a photogenerating layer and charge transport layer formed on the undercoat layer; an electrophotographic imaging member comprising a substrate, an undercoat layer deposited on the substrate, wherein the undercoat layer comprises a phenolic resin, an adhesion component, and titanium oxide dispersed therein, and a photogenerating layer and charge transport layer formed on the undercoat layer; an image forming apparatus for forming images on a recording medium comprising (a) an electrophotographic imaging member having a charge retentive-surface to receive an electrostatic latent image thereon, wherein the electrophotographic imaging member comprises a substrate, an undercoat layer disposed on the substrate, wherein the undercoat layer comprises a polyol resin, an aminoplast resin, an adhesion component, and a metal oxide dispersed therein, and at least one imaging layer, such as for example, a photogenerating layer and at least one charge transport layer, formed on the undercoat layer, (b) a development component adjacent to the charge-retentive surface for applying a developer material to the charge-retentive surface to develop the electrostatic latent image to form a developed image on the charge-retentive surface, (c) a transfer component adjacent to the charge-retentive surface for transferring the developed image from the charge-retentive surface to a copy substrate, and (d) a fusing component adjacent to the copy substrate for fusing the developed image to the copy substrate.

DETAILED DESCRIPTION

Aspects of the present disclosure relate to a member comprising a substrate, an undercoat layer thereover wherein the undercoat layer comprises a polyol resin, an aminoplast resin, an adhesion component, and a metal oxide dispersed therein; and at least one imaging layer formed on the undercoat layer; a photoconductor comprising a substrate, an undercoat layer thereover comprising a polyol resin, an aminoplast resin, a silicone free polyester component which primarily functions as an adhesion promoter, and a metal oxide, and a photogenerating layer, and at least one charge transport layer; a photoconductor comprising a supporting substrate, a hole blocking layer thereover comprising a polyol resin, an aminoplast resin, an adhesion component, and a metal oxide; and a photogenerating layer and a charge transport layer; a photoconductor wherein the photogenerating layer is situated between the charge transport layer and the substrate, and which layer contains a resin binder; and wherein the adhesion component is a silicone free polyester present in an amount of from about 1 to about 12 weight percent; a photoconductor comprising a substrate, an undercoat layer thereover comprised of a polyol resin, an aminoplast resin, a silicone free polyester adhesion component, and a metal oxide; and at least one imaging layer formed on the undercoat where the imaging layer can be comprised of a photogenerating layer and a charge transport layer; and a photoconductor comprising a substrate, a layer thereover comprising a polyol resin, an aminoplast resin, a substantially silicone free polyester, and a metal oxide usually dispersed therein, and a photogenerating layer, and at least one, such as 1 to 2, 1 to 4, charge transport layer containing hole transporting molecules, a resin binder, and additives such as antioxidants.

Examples of additives, or components include adhesion promoters selected in various suitable amounts for the photoconductors illustrated herein, and which amounts are, for example, from about 0.01 to about 40, from about 0.1 to about 20, or from 1 to about 10 weight percent, and which additives include polyester resins containing both acid and hydroxyl functionality with a number average molecular weight ($M_n$) of, for example, from 150 to 3,000 and a polydispersity of, for example, from about 1 to about 2. The additive, such as the adhesion promoter, can be incorporated in the undercoat layer by (1) directly adding into the already prepared undercoat layer dispersion comprising a metal oxide, polymeric resins and solvents; or (2) ball milling together with metal oxide, polymeric resins, solvents to generate the undercoat layer dispersion.

Suitable polyester additives that function primarily as adhesion promoters generally comprise, for example, the reaction product of (a) at least one difunctional carboxylic acid; (b) at least one trifunctional polyol; (c) at least one chain stopper, and (d) a phosphoric acid. Examples of suitable difunctional carboxylic acids of (a) include adipic acid, azelaic acid, fumaric acid, phthalic acid, sebacic acid, maleic acid, succinic acid, isophthalic acid, tetrahydrophthalic acid, hexahydrophthalic acid, dimer fatty acids, itaconic acid, glutaric acid, cyclohexanedicarboxylic acid, and mixtures thereof. Specific difunctional carboxylic acids of value are adipic acid and azelaic acid.

The at least one, such as for example, from 1 to about 8, 1 to about 4, or 1, trifunctional polyol (a) may be branched or unbranched. Examples of suitable trifunctional polyols (b) are trimethylolpropane, trimethylol ethane, glycerin, 1,2,4-butanetriol, mad mixtures thereof. The at least one chain stopper can be a carboxylic acid that is different from the at least one difunctional carboxylic acid (a), and more specifically, the chain stopper can be comprised of monocarboxylic acids. Suitable carboxylic acids (c) can contain one or more aromatic structures and also can contain a number of branched alkyl groups. Specific examples of suitable carboxylic acids (c) include para-t-butyl benzoic acid, benzoic acid, salicylic acid, 2-ethylhexanoic acid, pelargonic acid, isononanoic acid, $C_{18}$ fatty acids, stearic acid, lauric acid, palmitic acid, and mixtures thereof. At least one refers, for example, to 1 to about 10, from 1 to about 5, from 1 to about 3, and 1. The phosphoric acid component (d) should be present in amounts of from about 0.03 to about 0.20, from about 0.05 to about 0.15, or from about 0.07 to about 0.10 weight percent. Phosphate esters, such as butyl or phenyl acid phosphate and the like, including a number of known phosphate esters, are suitable for use as component (d).

Specific examples of UCL adhesion components include LUBRIZOL™ 2063, a hydroxyl/carboxy functional polymeric phosphate ester which is believed to be comprised in one variant of about 58 weight percent of solids in a butyl cellosolve, such as 2-butoxyethanol; LUBRIZOL™ 2062, the free acid of complex alkyl/aryl phosphate ester supplied in the range of about 59 to about 66 weight percent solids in isobutanol, available from Noveon Inc.; LUBRIZOL™ 2061; the free acid of complex alkyl phosphate ester supplied in the range of about 62 to about 70 weight percent solids in butyl cellosolve, available from Noveon; DEXTROL™ OC-22, the phosphate ester of nonyl phenol ethoxylate, available from Dexter Chemical LLC; STRODEX™ MR-100; the phosphate ester of aromatic ethoxylate, available from Dexter Chemical LLC; GENORAD™ 40, a methacrylated phosphate ester, available from RAHN USA Corporation; a silicone free or substantially silicone free polyester resin like BORCHI GEN HMP™, available from Borchers GmbH, comprised in one variant of 80 percent by weight of solids dispersed in 1-propanol and N-methyl-2-pyrrolidinone; WORLEEADD™ 486, a polyester resin supplied at 75 weight percent solids in xylene/n-butanol/N-methyl-2-pyrrolidinone, available from Worlee-Chemie G.m.b.H; CN704™, an acrylated polyester resin, available from Sartomer; ADHESION RESIN™ LTW, a special purpose polyester resin supplied at 60 weight percent solids in xylene, available from Degussa Corporation; esters of phosphoric acid, such as phosphate esters of tridecyl alcohol ethoxylates; alkyl phenol ethoxylates; alkyl polyethoxyethanol; alkylphenoxypolyethoxyethanols, such as STEPFAC™ 8170 and 8180, available from Stepan Corporation; polyarylates such as poly-4, 4'-isopropylidenediphenylene terephthalate/isophthalate copolymers, available from Toyota Hsutsu; polyesters such as MOR-ESTER™ 49,000, available from Morton International; vinyl ester resins; isophthalic polyester resins and orthophthalic polyester resins; copolyesters, such as polyethyleneterephthalate glycol; and optionally mixtures thereof; and the like.

A polyol resin that can be selected includes, for example, an acrylic polyol resin. More specifically, examples of polyol resins that may be included are polyglycol, polyglycerol, and mixtures thereof. Additional examples of polyol resins include PARALOID™ AT-400 with a $M_w$ of about 15,000, a hydroxyl equivalent weight of 652, and an acid number of 25; PARALOID™ AT-410 with a $M_w$ of about 9,000, a hydroxyl equivalent weight of 877, and an acid number of 25; RU-1100-1k™ with a $M_n$ of about 1,000, and a 112 hydroxyl value; and RU-1550-k5™ with a $M_n$ of about 5,000 and 22.5 hydroxyl value, both available from Procachem Corporation; G-CURE™ 108A70 available from Fitzchem Corporation, NEOL® based polyester polyol, available from BASF; and TONE™ 0201 polyol with a $M_n$ of about 530, a hydroxyl number of 117, and an acid number of <0.25, available from Dow Chemical Company. Examples of aminoplast resins include SUMIMAL™ M40S, SUMIMAL™ M50S, both available from Sumitomo Chemical; CYMEL™ 323, CYMEL™ 327, CYMEL™ 303, all available from CYTEC Corporation; or GP 401W51™, available from Georgia-Pacific. The aminoplast resin may be selected, for example, from urea, melamine such as CYMEL™ 323, available from CYTEC Corporation, which is comprised of about 78 to about 84 percent of methylated melamine formaldehyde resin, and about 16 to about 21 percent (percent by weight) of isobutanol, and mixtures thereof.

A metal oxide is usually dispersed in the undercoat layer resins, for example, the metal oxide can be dispersed in the resin or resins followed by heating. In embodiments, the metal oxide has a size diameter of from about 5 to about 300 nanometers, a powder resistance of from about $1\times10^3$ to about $6\times10^4$ ohm/cm when applied at a pressure of from about 50 to about 650 kilograms/cm$^2$. In one embodiment, titanium dioxide $TiO_2$ is selected as the metal oxide in the undercoat layer formulation.

In embodiments, the metal oxide like TiO2 can be surface treated with, for example, aluminum laurate, alumina, zirconia, silica, silane, methicone, dimethicone, sodium metaphosphate, and the like, and mixtures thereof. Examples of TiO2 include MT-150W™ (surface treatment with sodium metaphosphate, Tayca Corporation), STR-60N™ (no surface treatment, Sakai Chemical Industry Co., Ltd.), FTL-100™ (no surface treatment, Ishihara Sangyo Laisha, Ltd.), STR-60™ (surface treatment with $Al_2O_3$, Sakai Chemical Industry Company, Ltd.), TTO-55N™ (no surface treatment, Ishihara Sangyo Laisha, Ltd.), TTO-55A™ (surface treatment with $Al_2O_3$, Ishihara Sangyo Laisha, Ltd.), MT-150AW™ (no surface treatment, Tayca Corporation), MT-150A™ (no surface treatment, Tayca Corporation), MT-100S™ (surface treatment with aluminum laurate and alumina, Tayca Corporation), MT-100HD™ (surface treatment with zirconia and alumina, Tayca Corporation), MT-100A™ (surface treatment with silica and alumina, Tayca Corporation); $TiO_2$/VARCUM™ resin mixture in a 1:1 ratio of n-butanol:xylene containing from about 2 to about 50 weight percent of an added electron transport material based on the total solid concentration in solution, and wherein the aforementioned main component mixture amount is, for example, from about 80 to about 100 weight percent, and more specifically, from about 90 to about 99 weight percent, and yet more specifically, wherein the titanium oxide possesses a primary particle size diameter of from about 10 to about 25 nanometers, and more specifically, from about 12 to about 17 nanometers, and yet more specifically, about 15 nanometers with an estimated aspect ratio of from about 4 to about 5, and which is optionally surface treated with, for example, a component containing, for example, such as a sodium metaphosphate, from about 1 to about 3 percent by weight, a powder resistance of from about $1\times10^4$ to about $6\times10^4$ ohm/cm when applied at a pressure of from about 650 to about 50 kilograms/cm$^2$; and the like. The amount of metal oxide incorporated in the UCL is from about 0.1 to 99 percent relative to the total solid weight, and more specifically, from about 20 to about 80 percent by weight based upon the total solids weight. Metal oxide examples in addition to titanium are chromium, zinc, tin, and the like, and more specifically, zinc oxide, tin oxide, aluminum oxide, silicone oxide, zirconium oxide, indium oxide, molybdenum oxide, and mixtures thereof.

The hole blocking layer (UCL) can in embodiments be prepared by a number of known methods; the process parameters being dependent, for example, on the member desired. The hole blocking layer can be coated as solution or a dispersion onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours, under stationary conditions or in an air flow. The coating can be accomplished to provide a final coating thickness of from about 1 to about 25 microns after drying.

Optional binders can also be added to the undercoat layer, such as polyesters like MOR-ESTER™ 49,000, available from Morton International Inc.; VITEL™ PE-100, VITEL™ PE-200, VITEL™ PE-200D, and VITEL™ PE-222, available from Goodyear Tire and Rubber Co.; polyarylates such as ARDEL™ from AMOCO Production Products; polysulfone, from AMOCO Production Products, polyurethanes; a polyamide such as LUCKAMIDE™ 5003, available from DAINIPPON Ink and Chemicals; NYLON™ 8 with methylmethoxy pendant groups; CM 4000™ and CM 8000™, available from Toray Industries Ltd., and other N-methoxymethylated polyamides, such as those prepared according to the method described in Sorenson and Campbell "Preparative Methods of Polymer Chemistry" second edition, page 76, John Wiley and Sons Inc. (1968), the disclosure of which is totally incorporated herein by reference, and the like, and mixtures thereof. These polyamides can be alcohol soluble, for example with polar functional groups, such as methoxy, ethoxy and hydroxy groups, pendant from the polymer backbone. Another example of undercoat layer binder materials includes phenolic-formaldehyde resin, such as VARCUM™ 29159 from OXYCHEM; aminoplast-formaldehyde resin such as CYMEL™ resins from CYTEC Corporation, poly (vinyl butyral) such as BM-1™, available from Sekisui Chemical, and the like, and mixtures thereof. The amount of binder incorporated in the UCL is from about 1 to 80 percent relative to the total solids weight, and more specifically, from about 10 to about 70 percent by weight relative to the total solids weight. The weight average molecular weight ($M_w$) of the binder resin can be, for example, from about 500 to about 100,000, or from about 1,000 to about 10,000, and the number average molecular weight ($M_n$) can be, for example, from about 100 to about 6,000, or from about 200 to about 1,500.

The weight/weight ratio of the polyol and aminoplast resin in the undercoat layer formulation is, for example, from about 5/95 to about 95/5, or from about 25/75 to about 75/25. The weight/weight ratio of the polyol and aminoplast resin to the metal oxide, such as titanium dioxide, in the undercoat layer formulation is, for example, from about 10/90 to about 90/10, or from about 30/70 to about 70/30. In embodiments, the aminoplast resin is present in an amount of from about 5 percent to about 80 percent, or from about 5 percent to about 75 percent, or from about 20 percent to about 80 percent by weight of the total weight of the undercoat layer components. The polyol resin is present in an amount of, for example, from about 5 percent to about 80 percent, from about 5 percent to about 75 percent, or from about 20 percent to about 80 percent by weight of the total weight of the undercoat layer components. The metal oxide, like $TiO_2$, is present in an amount of, for example, from about 10 percent to 90 percent, or from about 20 percent to about 80 percent by weight of the total weight of the undercoat layer components. The undercoat layer may further contain optional light scattering particle or particles with, for example, a refractive index different than the binder and, for example, with a number average particle size diameter equal to or greater than about 0.8 μm, such as from about 8 to about 20 microns. The light scattering particles can be comprised of amorphous silica or silicone balls. In various embodiments, the light scattering particles can be present in an amount of, for example, from about 0 percent to about 10 percent by weight of the total weight of the undercoat layer. The undercoat layer has a suitable thickness of, for example, from about 0.1 μm to about 40 μm, from about 2 μm to about 25 μm, or from about 10 μm to about 20 μm. In further embodiments, the resins/metal oxide combination is present in an amount of from about 20 percent to about 80 percent, or from about 40 percent to about 70 percent by weight of the total weight of the undercoat layer components.

The hole blocking or undercoat layer for the imaging members of the present disclosure can contain a number of components in addition to the resin mixture and adhesion component including, for example, known hole blocking components, such as amino silanes, doped metal oxides, TiSi, oxides of chromium, zinc, tin, and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 weight percent to about 50 weight percent of a phenolic resin; from about 2 weight percent to about 20 weight percent and, more specifically, from about 5 weight percent to about 15 weight percent of a phenolic compound preferably containing at least two phenolic groups, such as bisphenol S; and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The thickness of the photoconductor substrate layer depends on many factors, including economical considerations, electrical characteristics, and the like, thus this layer may be of substantial thickness, for example over 3,000 microns, such as from about 300 to about 700 microns, or of a minimum thickness. In embodiments, the thickness of this layer is from about 75 microns to about 300 microns, or from about 100 to about 150 microns. The substrate may be opaque or substantially transparent and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired, and economical considerations. For a drum, as disclosed in a copending application referenced herein, this layer may be of substantial thickness of, for example, up to many centimeters or of a minimum thickness of less than a millimeter. Similarly, a flexible belt may be of a substantial thickness of, for example, about 250 micrometers, or of minimum thickness of less than about 50 micrometers provided there are no adverse effects on the final electrophotographic device. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

illustrative examples of substrates are as illustrated herein, and more specifically, substrates selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer may be comprised of amorphous films of selenium and alloys of selenium and arsenic, tellurium, germanium and the like, hydrogenated amorphous silicone and compounds of silicone and germanium, carbon, oxygen, nitrogen, and the like fabricated by vacuum evaporation or deposition. The photogenerating layers may also comprise inorganic pigments of crystalline selenium and its alloys; Group II to VI compounds; and organic pigments such as quinacridones; polycyclic pigments such as dibromo anthanthrone pigments, perylene and perinone diamines, polynuclear aromatic quinones, azo pigments including bis-, tris- and tetrakis-azos; hydroxygallium phthalocyanines, metal free phthalocyanines, metal phthalocyanines, hydroxy halophthalocyanines, titanyl phthalocyanines, and the like dispersed in a film forming polymeric binder and fabricated by solvent coating techniques.

Infrared sensitivity is usually desired for photoreceptors exposed to low-cost semiconductor laser diode light exposure devices, with examples of these photoreceptors including in the photogenerating layer oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal free phthalocyanine. The phthalocyanines exist in many crystal forms, and have a strong influence on photogeneration.

Examples of polymeric binder materials that can be selected as the matrix for the photogenerating layer components are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The photogenerating composition or pigment is present in the resinous binder composition in various effective amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. The hole blocking layer or UCL may be applied to the electrically conductive surface prior to the application of a photogenerating layer.

In embodiments, a suitable known adhesive layer can be included in the photoconductor. Typical adhesive layer materials include, for example, polyesters, polyurethanes, and the like. The adhesive layer thickness can vary, and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicone nitride, carbon black, and the like, to provide, for example, in embodiments of the present disclosure further desirable electrical and optical properties.

A number of known charge transport components and molecules can be selected for the charge transport layer, such as aryl amines, and which layer is generally of a thickness of from about 5 microns to about 75 microns, and more specifically, of a thickness of from about 10 microns to about 40 microns, and which components include molecules of the following formula

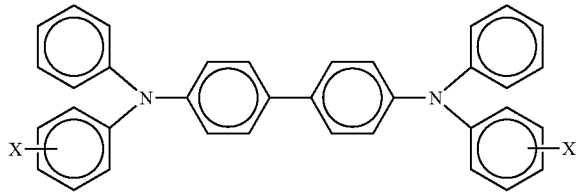

wherein X is a suitable hydrocarbon like at least one of alkyl, alkoxy, and aryl, and substituted derivatives thereof; a halogen, or mixtures thereof, and especially those substituents selected from the group consisting of Cl and $CH_3$; and molecules of the following formula

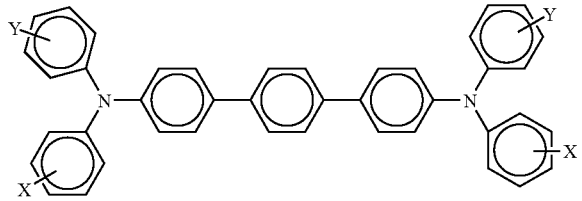

wherein X and Y are independently a suitable hydrocarbon, such as at least one of alkyl, alkoxy, and aryl, and substituted derivatives thereof; a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of charge transporting molecules, especially for the first and second charge transport layers, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material or a combination of a small molecule charge transport material and a polymeric charge transport material.

A number of processes may be used to mix and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is, for example, from about 10 to about 75, from about 15 to about 50 micrometers, but thicknesses outside these ranges may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to about 200:1, and in some instances 400:1. The charge transport layer is substantially nonabsorbing to visible light or radiation in the region of intended use, but is electrically "active" in that it allows the injection of photogenerated holes from the photoconductive layer or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 micrometers. In embodiments, this thickness for each layer can be, for example, from about 1 micrometer to about 5 micrometers. Various suitable and conventional methods may be used to mix, and thereafter apply the overcoat layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration. Free carrier concentration in the overcoat increases the dark decay.

The following Examples are provided. All proportions are by weight unless otherwise indicated.

Illustrative photoresponsive imaging members or photoconductors were fabricated as follows. Multilayered photoreceptors of the rigid drum design were fabricated by conventional coating technology with an aluminum drum of 34 millimeters in diameter as the substrate. All the photoreceptors contained the same photogenerating layer and the same charge transport layer. The differences are that Comparative Example 1 contained an undercoat layer (UCL) comprising an acrylic polyol resin, a melamine resin, and titanium oxide; Example I contained the same layers as Comparative Example 1 except that a polyester resin was incorporated into the UCL.

Comparative Example 1

An undercoat dispersion was prepared as follows: 88.1 grams of titanium oxide $TiO_2$ MT-150W™ (95 weight percent solids) were attritor milled in a binder system of 32.05 grams of CYMEL™ 323 melamine resin (80 weight percent solids), and 34.2 grams of PARALOID™ AT-400 polyol resin (75 weight percent solids) in 145 grams of methyl ethyl ketone (MEK) using 900 grams of 0.4 to 0.6 millimeters of zirconium oxide beads. The milling proceeded for 30 minutes to an endpoint surface area of 13.4 $m^2$/gram, as measured by the Horiba Capa 700 Particle Size Analyzer, resulting in a 62:19:19 $TiO_2$ MT-150W™/CYMEL™ 323/PARALOID™ AT-400 dispersion in MEK. The solution was collected by filtration through a 20 μm nylon filter. The dispersion was let down to 38 percent solids through addition of more MEK. An experimental device was prepared by coating the undoped undercoat layer at 5 micron thickness at a curing condition of 145° C./30 minutes on an aluminum drum. More specifically, a 0.2 to 0.5 micron thick charge generating layer comprised of chlorogallium phthalocyanine, and a 29 micron thick charge transport layer comprised of N,N'-bis(methylphenyl)-1,1-biphenyl-4,4'-diamine, a polycarbonate (PCZ, a LUPILON 200™ (PCZ-200) or POLYCARBONATE Z™, weight average molecular weight of about 20,000, available from Mitsubishi Gas Chemical Corporation), and PTFE particles were coated on the UCL and dried at 115° C./40 minutes (C=degrees Centigrade).

Example I

The UCL composition was prepared by repeating the process of Comparative Example 1 except that 20 grams of the let-down dispersion were doped with 36 milligrams of the Borchi Gen HMP solution (80 weight percent solids in 1-propanol and N-methyl-2-pyrrolidinone), a commercially available silicone free polyester solution from Lanxess Corporation, and rolled overnight, about 18 hours. An experimental device was prepared by coating the aforementioned doped undercoat layer at a 5 micron thickness at a curing condition of 145° C./30 minutes on an aluminum drum. More specifically, a 0.2 to 0.5 μm thick charge generating layer comprised of chlorogallium phthalocyanine and a 29 micron thick charge transport layer comprised of N,N'-bis(methylphenyl)-1,1-biphenyl-4,4'-diamine, the above polycarbonate (PCZ), and PTFE particles were coated on the UCL and dried at 115° C./40 minutes.

An empirical peel test was performed to determine the adhesion properties of the undercoat layer with other imaging layers and the substrate. This test involved scoring the photoconductive drum with a razor in a crosshatch pattern with 4 to 6 millimeter spacing, affixing a 1 inch piece of scotch tape to the device, and removing it and examining the amount of delamination onto the tape. An empirical scale was developed from Grade 1 to Grade 5 with Grade 1 resulting in almost no delamination and Grade 5 resulting in almost complete delamination. With the addition of the above polyester into the undercoat layer of Example I, the adhesion to the photoconductor layers was improved by about 1 to 2 grades, as contrasted to Comparative Example 1.

The above prepared photoreceptor devices were tested in a scanner set to obtain photoinduced discharge characteristic (PIDC) curves, sequenced at one charge-erase cycle followed by one charge-expose-erase cycle, wherein the light intensity was incrementally increased with cycling to produce a series of PIDC curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of about 500 and about 700 volts with the exposure light intensity incrementally increased by means of regulating a series of neutral density filters. The exposure light source was a 780 nanometer light emitting diode. The aluminum drum was rotated at a speed of about 55 revolutions per minute to produce a surface speed of about 122 millimeters per second. The xerographic simulation was completed in an environmentally controlled light tight chamber at ambient conditions (about 50 percent relative humidity and about 22° C.).

Very similar PIDC curves were observed for both of the above photoreceptor devices, thus the undercoat layer containing the polyol, melamine, and silicone free polyester resin performs very similarly to the undercoat layer without the polyester additive from the point of view of PIDC. The Example I device showed normal electrical properties with similar residual voltage and charge acceptance to that of the comparative reference device. The $V_{dep}$, $V_{low}$, dV/dX, $V_{erase}$, and dark decay all suggest the new undercoat layer is functioning properly.

The above photoreceptor drums were then acclimated for 24 hours before testing at 70° F./10 percent RH (F=degrees Fahrenheit) in a Xerox Corporation Copeland Work Centre Pro 3545 machine using K station at t=0 and t=500 print count. Run-ups from t=0 to t=500 prints for all devices were completed in one of the CYM color stations. Ghosting levels were measured against an internal visual scale, the TSIDU SIR scale. The stressful combination of Kutani CRUM and Tokai BCR was used for evaluating ghosting in the devices, where ghosting levels of 0 to 6 were defined with 0 showing no ghosting, and 6 most severe ghosting.

The ghosting tests revealed that the photoconductor of Example I with the polyester undercoat layer indicated an excellent ghosting level of G2 at t=0 and G3.5 at t=500, which are better than levels typically observed from regular organozirconium based three-component undercoating layer devices where ghosting is usually G6, even at t=0, and that of Comparative Example 1 with a ghosting value of G5. Therefore, incorporation of polyol, melamine and silicone free polyester resin in combination with a metal oxide, such as titanium oxide, in the undercoat layer improved print quality such as ghosting. The testing results demonstrate that the polyester containing undercoat layer photoconductor exhibits minimum, no, or low ghosting images even at severe testing conditions.

Alternatively, the UCL can be formed with other silicone free polyesters such as WORLEEADD™ 486, a polyester resin supplied at 75 weight percent solids in xylene/n-butanol/N-methyl-2-pyrrolidinone, available from Worlee-Chemie G.m.b.H, CN704™, an acrylated polyester resin available from Sartomer, and ADHESION RESIN™ LTW, a special purpose polyester resin supplied at 60 weight percent solids in xylene, available from Degussa Corporation, esters of phosphoric acid, such as phosphate esters of tridecyl alcohol ethoxylates, alkyl phenol ethoxylates, alkyl polyethoxyethanol, alkylphenoxypolyethoxyethanol such as STEPFAC™ 8170 and 8180, available from Stepan Corporation.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductive member comprising a substrate, an undercoat layer thereover comprised of a polyol resin, an aminoplast resin present in an amount of from about 5 to about 20 percent by weight, a silicone free polyester adhesion component, and a metal oxide; and at least one imaging layer formed on the undercoat layer wherein the thickness of the undercoat layer is from about 0.1 μm to about 40 μm, and the imaging layer is comprised of a photogenerating layer and a charge transport layer; and further including a crosslinking agent in the undercoat layer, the crosslinking agent being selected from the group consisting of at least one of p-toluenesulfonic acid, naphthalenesulfonic acid, phthalic acid, maleic acid, amine salts of inorganic acids, and ammonium salts of inorganic acids; and wherein said polyester adhesion component is an acrylated polyester.

2. A member in accordance with claim 1 wherein the polyol resin is present in an amount of from about 5 percent to about 80 percent by weight of the total weight of the undercoat layer components.

3. A member in accordance with claim 1 wherein the metal oxide is present in an amount of from about 10 percent to about 90 percent by weight of the total weight of the undercoat layer components.

4. A photoconductor in accordance with claim 1 wherein the polyol resin is selected from the group consisting of acrylic polyols, polyglycols, polyglycerols, and mixtures thereof; and said substrate is present.

5. A photoconductor in accordance with claim 1 wherein the metal oxide is selected from the group consisting of zinc oxide, tin oxide, aluminum oxide, silicone oxide, zirconium oxide, indium oxide, molybdenum oxide, and mixtures thereof.

6. A photoconductor in accordance with claim 1 wherein the metal oxide possesses a size diameter of from about 5 to about 300 nanometers, a powder resistance of from about $1\times10^3$ to about $6\times10^4$ ohm/centimeter when applied at a pressure of from about 50 to about 650 kilograms/$cm^2$.

7. A photoconductor in accordance with claim 1 wherein the metal oxide is titanium dioxide.

8. A photoconductor in accordance with claim 1 wherein the silicone free polyester possesses a weight average molecular weight $M_w$ of from about 500 to about 100,000, and a number average molecular weight $M_n$ of from about 300 to about 50,000.

9. A photoconductor in accordance with claim 1 wherein said silicone free polyester is present in an amount of from about 0.1 to about 40 weight percent.

10. A photoconductor in accordance with claim 1 wherein said silicone free polyester is present in an amount of from about 0.01 to about 20 weight percent.

11. A photoconductor in accordance with claim 1 wherein said silicone free polyester is present in an amount of from about 0.1 to about 12 weight percent.

12. A photoconductor in accordance with claim 1 wherein said silicone free polyester possesses a number average molecular weight of from about 150 to about 10,000; and a polydispersity of from about 1 to about 2.

13. A photoconductor in accordance with claim 1 wherein each of said metal oxide, and said polyol are present in an amount of from about 20 percent to about 80 percent by weight of the total weight of the layer components.

14. A photoconductor in accordance with claim 1 wherein said charge transport layer is comprised of aryl amine molecules, and which aryl amines are of the formula

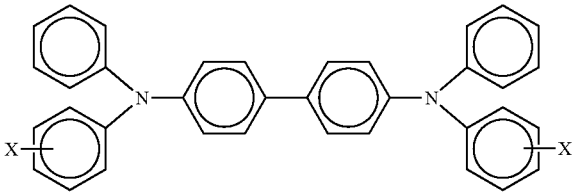

wherein X is selected from the group consisting of at least one of alkyl, alkoxy, aryl, and halogen, and wherein at least one is from 1 to about 3; and said substrate is present.

15. A photoconductor in accordance with claim 14 wherein said alkyl and said alkoxy each contains from about 1 to about 12 carbon atoms, and said aryl contains from about 6 to about 36 carbon atoms.

16. A photoconductor in accordance with claim 14 wherein said aryl amine is N,N'-diphenyl-N,N-bis(3-methylphenyl)-1,1'-biphenyl-4,4'-diamine.

17. A photoconductor in accordance with claim 1 wherein said charge transport layer is comprised of molecules of the formula

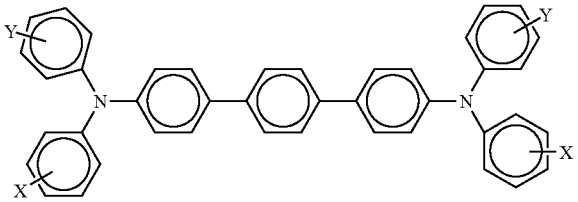

wherein X and Y are independently selected from the group consisting of at least one of alkyl, alkoxy, aryl, and halogen.

18. A photoconductor in accordance with claim 17 wherein alkyl and alkoxy each contains from about 1 to about 12 carbon atoms, and aryl contains from about 6 to about 36 carbon atoms; and wherein said charge transport layer is 1, 2, 3, or 4 layers.

19. A photoconductor in accordance with claim 17 wherein said aryl amine is selected from the group consisting of at least one of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine.

20. A photoconductor in accordance with claim 1 wherein said photogenerating layer is comprised of a photogenerating pigment.

21. A photoconductor in accordance with claim 20 wherein said photogenerating pigment is comprised of at least one of a metal phthalocyanine, a metal free phthalocyanine, a titanyl phthalocyanine, a halogallium phthalocyanine, and a perylene.

22. A photoconductor in accordance with claim 20 wherein said photogenerating pigment is comprised of a chlorogallium phthalocyanine, or wherein said photogenerating pigment is comprised of a hydroxygallium phthalocyanine.

23. A photoconductor in accordance with claim 1 wherein said photoconductor is a drum or a flexible belt, wherein said charge transport layer is 1, 2, 3, or 4 layers, and wherein said substrate is comprised of an insulating material or a conductive material.

24. A photoconductor in accordance with claim 1 wherein said charge transport layer is from 1 to about 7 layers.

25. A photoconductor in accordance with claim 1 wherein said charge transport layer is from 1 to about 3 layers.

26. A photoconductor in accordance with claim 1 wherein said charge transport layer is comprised of a charge transport component and a resin binder, and said photogenerating layer is comprised of at least one photogenerating pigment and a resin binder, and further wherein said charge component is comprised of hole transport molecules.

* * * * *